US006036294A

United States Patent [19]

Banicevic et al.

[11] Patent Number: 6,036,294

[45] Date of Patent: Mar. 14, 2000

[54] REFRIGERATOR MULLION

[75] Inventors: Nedo Banicevic, Hamilton; Murray Klaas, Burlington, both of Canada

[73] Assignee: Camco Inc., Mississauga, Canada

[21] Appl. No.: 09/024,194

[22] Filed: Feb. 17, 1998

[30] Foreign Application Priority Data

May 29, 1997 [CA] Canada ..... 2206506

[51] Int. Cl.[7] ..... A47B 96/04

[52] U.S. Cl. ..... 312/407; 312/296

[58] Field of Search ..... 312/296, 400, 312/401, 405, 406, 407; 52/282.2; 62/441, 447, 465; 292/251.5; 49/475.1, 478.1

[56] References Cited

U.S. PATENT DOCUMENTS

| | | | |
|---|---|---|---|
| 3,835,660 | 9/1974 | Franck . | |
| 4,150,518 | 4/1979 | Truesdell et al. . | |
| 4,170,391 | 10/1979 | Bottger . | |
| 4,330,310 | 5/1982 | Tate, Jr. et al. . | |
| 4,550,576 | 11/1985 | Tate, Jr. et al. | 62/447 X |
| 4,558,503 | 12/1985 | Wilson . | |
| 4,606,112 | 8/1986 | Jenkins et al. . | |
| 4,632,470 | 12/1986 | Jenkins et al. . | |
| 4,822,117 | 4/1989 | Boston, Jr. . | |
| 4,852,303 | 8/1989 | Rolek . | |
| 4,884,415 | 12/1989 | Mandel et al. . | |
| 4,914,341 | 4/1990 | Weaver et al. . | |
| 4,941,289 | 7/1990 | Rolek . | |
| 4,955,676 | 9/1990 | Weaver et al. . | |
| 5,154,502 | 10/1992 | Takaoka . | |
| 5,255,531 | 10/1993 | Williams et al. . | |
| 5,309,680 | 5/1994 | Kiel | 49/478.1 |
| 5,349,832 | 9/1994 | Johnson et al. . | |

*Primary Examiner*—Anthony Knight
*Assistant Examiner*—Karlena D. Schwing

[57] ABSTRACT

A refrigerator cabinet has an outer metallic shell into which is inserted a one-piece plastic interior liner having a fresh food compartment separated by a mullion wall from the freezer compartment. The mullion wall is part of the interior liner. A metallic reinforcing mullion strap extends between side walls of the exterior cabinet shell to reinforce the side walls and prevent buckling. The mullion strap extends through an open space between the fresh food compartment and freezer compartment on the interior liner. The mullion strap does not touch the interior liner and is surrounded by thermally insulating foam whereby heat loss through the mullion strap from the refrigerator compartment is reduced. Further, the mullion wall of the interior liner is covered by a plastic mullion cap which protects the mullion wall of the interior liner from stresses associated with door closure and includes a decorative mullion cover in which a heater is provided to compensate for sweating associate with heat loss through the mullion cap to ambient. By using a plastic mullion cap, heat loss is significantly less than using a metal mullion bar directly exposed to ambient.

20 Claims, 6 Drawing Sheets

REFRIGERATOR MULLION

FIELD OF THE INVENTION

The present invention relates generally to refrigerator cabinets and in particular relates to a mullion construction for refrigerator cabinets having enhanced heat transfer characteristics while maintaining decorative appearance flexibility.

BACKGROUND OF THE INVENTION

In the construction of a refrigerator cabinet, it is typical to include a metal mullion bar position between side walls of a horizontally disposed freezer and fresh food compartment or between the top and bottom walls of side-by-side freezer and fresh food compartment. The purpose of the mullion bar or rail is well known to provide support between the side walls of the refrigerator and to provide a load bearing structure about which the liners of the freezer and fresh food compartment are constructed.

The mullion rails or bars are located across the open front of the refrigerator cabinet exposed to the ambient atmosphere and at least a portion of the interior liner of the freezer compartment and/or the fresh food compartment. Typically, the mullion bar provides a structural support to which a partition for the freezer and fresh food compartments are constructed. Since the mullion bar is a metallic material, the mullion is a good heat transfer medium between the ambient atmosphere and the freezer compartment and/or the fresh food compartment. When the ambient is humid, condensation appears on the face of the mullion bar. To prevent sweating the mullion bar has heater which warms the mullion surface exposed to the ambient. However these heaters also heat the fresh food compartment and/or freezer compartment raising the energy requirements needed to maintain operation of the refrigerator.

The mullion bar also provides a reinforced surface against which the doors may close. The door includes a gasket having magnets which are attracted to the metal mullion bar to effect a seal against the mullion bar. Thus the mullion bar is required to provide an effective seal against the door gaskets which must withstand the stresses of repeated door closure and provide a magnetic attracting medium.

SUMMARY OF THE INVENTION

The present invention relates to a refrigerator cabinet having improved heat transfer characteristics associate with the mullion. In particular, a metallic reinforcing mullion rail or strap is located in a space between the freezer compartment and fresh food compartment of an interior plastic liner. The mullion rail is secured relative to side walls of the metal exterior cabinet shell to strengthen the walls of the refrigerator outer shell. However, the mullion strap is positioned in non-contacting relation to the interior liner and is surrounded by thermally insulating foam to significantly reduce heat loss or transfer through the mullion strap to the ambient since the mullion strap is not touching the interior liner and is not in direct contact with the ambient.

In accordance with one aspect of the present invention there is provided a refrigerator cabinet comprising an exterior metallic cabinet shell having a top wall, a bottom wall and side walls having an open side. The cabinet includes a plastic interior liner adapted to fit within the exterior cabinet shell. The interior liner has first and second interior cavities defining respectively a fresh food compartment and a freezer compartment. The interior liner has a mullion wall having a relatively flat surface portion extending between the side walls and facing forward towards the open side. The mullion wall separates the first and second cavities to define a space between the first and second cavities. The cabinet includes a reinforcing mullion strap extending between and connected with the side walls. The mullion strap is located in the space between the first and second cavities. The mullion strap is spaced away from and behind the mullion wall in non-contacting relation with the interior liner. An insulating foam is located in the space between the first and second cavities thermally insulating the mullion strap from the interior liner.

By locating the reinforcing mullion strap within the space between the first and second cavities in non-contacting relation with the interior liner, heat loss through the mullion strap is significantly reduced.

The refrigerator cabinet preferably includes a plastic mullion cap overlying the mullion wall. The mullion cap has a central recess extending along the mullion cap between the side walls. The mullion cap defines two elongate magnet receiving channels on an inside surface of the mullion cap spaced apart from each other by the central recess. Elongate magnets extend along each of the magnet receiving channels between the mullion cap and mullion wall against which door closing magnets may seal. A decorative mullion cover is inserted into the central recess of the mullion cap. The mullion cover preferably includes elongate tubes for carrying warm refrigerant to heat an outer surface of the mullion cover.

By using a plastic mullion cap overlaying the mullion wall of the liner, the mullion cap allows for decorative styling of the mullion cover. Further, the mullion cap is a strengthened surface against which the doors may close. The million cap distributes the closing load over the mullion wall surface without direct contact between the mullion wall surface of the interior liner and the door. The mullion cap also carries the magnets to provide relatively easy assembly of the mullion magnets against the outside surface of the mullion wall. Because the plastic mullion cap extends into the freezer compartment and the fresh food compartment and overlies the mullion wall of the liner, this plastic mullion cap does not conduct or transfer heat as readily as a mullion metal bar. Also the mullion cap shields the mullion wall of liner from direct exposure to the ambient.

Preferably the mullion strap is located along a first elongate axis parallel to a second elongate axis passing through the central recess of the mullion cap. The mullion strap has the first elongate axis spaced horizontally below the second elongate axis. As a consequence, the reinforcing mullion strap aligns horizontally adjacent the closing gasket of the lower and usually heavier doors of the fresh food compartment to provide greater support for the mullion cross piece of the refrigerator or cabinet. Also, to reduce heat loss, the mullion strap is located closer to the relatively warmer fresh food compartment and further away from the relatively cooler freezer compartment.

In accordance with another aspect of the present invention there is provided a refrigerator comprising a refrigerator cabinet and first and second pairs of refrigerator doors. The refrigerator cabinet includes an exterior metallic cabinet shell having a top wall, a bottom wall and side walls having an open side. The cabinet has a plastic interior liner adapted to fit within the exterior cabinet shell. The interior liner has two interior cavities defining respectively a fresh food compartment and a freezer compartment. The interior liner has a mullion wall having a relatively flat surface portion extending between the side walls and facing forward towards the open side. The mullion wall separates the first and second cavities to define a space therebetween. The cabinet further includes a mullion cap overlying the plastic mullion wall. The mullion cap defines two elongate magnet receiving channels on an inside surface of the mullion cap spaced apart from each other. Elongate magnets extend along each of the magnet receiving channels between the mullion cap and mullion wall.

BRIEF DESCRIPTION OF THE DRAWINGS

For a better understanding of the nature and objects of the present invention reference may be had by way of example to the accompanying diagrammatic drawings in which.

DETAILED DESCRIPTION OF EMBODIMENTS

Figure 1:
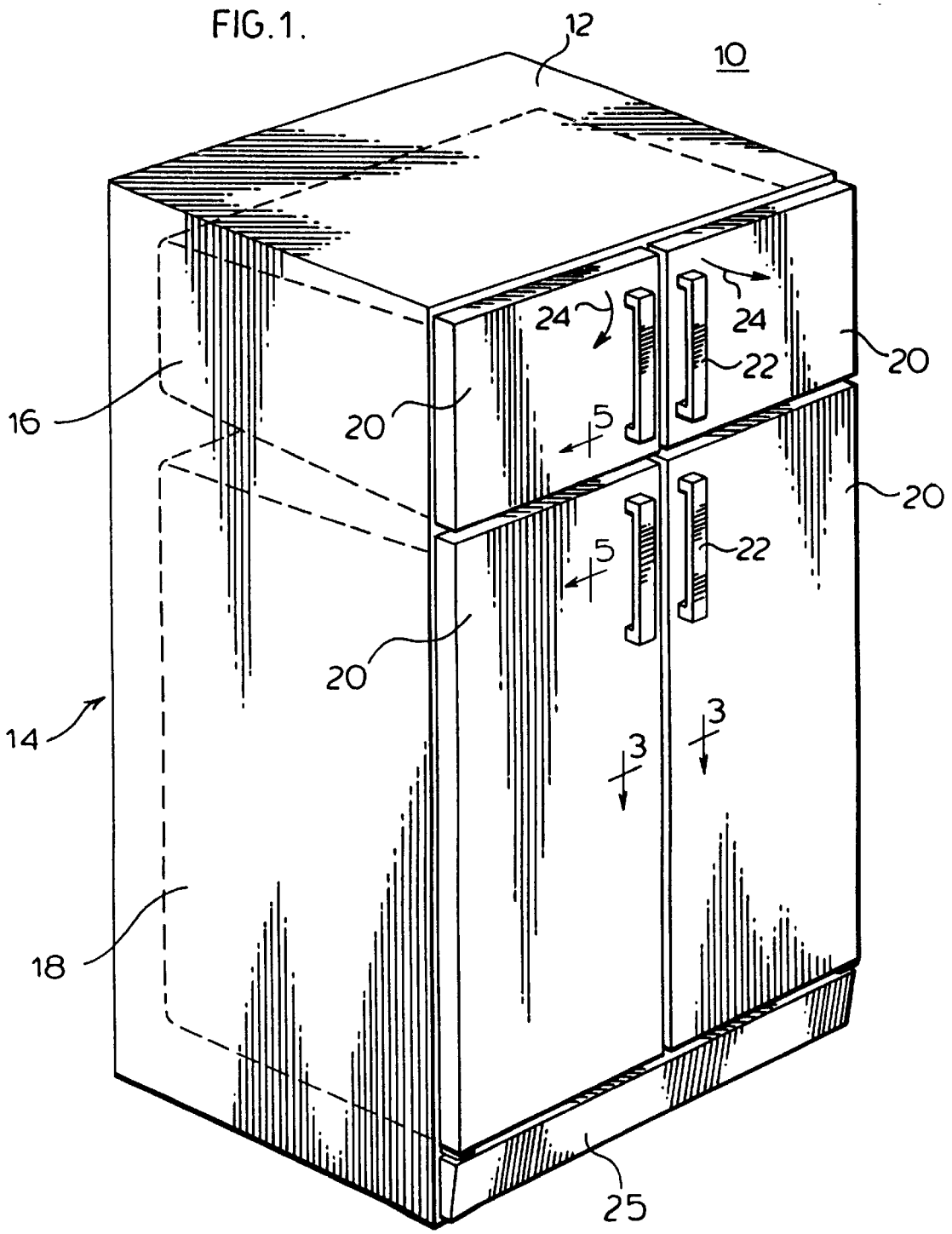
FIG. 1 is a perspective view of a refrigerator having side-by-side, or "French" doors.

Referring to FIG. 1, there is shown a domestic refrigerator 10 having an exterior cabinet shell 12. The refrigerator 10 includes an interior liner 14. Interior liner 14 includes two bubble sections or cavities providing an upper freezer compartment 16 and a lower fresh food compartment 18. Access to the freezer compartment 16 and the fresh food compartment 18 is permitted at the front of the refrigerator 10 by opening doors 20. Doors 20 have handles 22 which facilitate opening of the doors which swing open in the direction shown by arrows 24. The bottom of the refrigerator 10 has a decorative kick plate 25.

Figure 2:
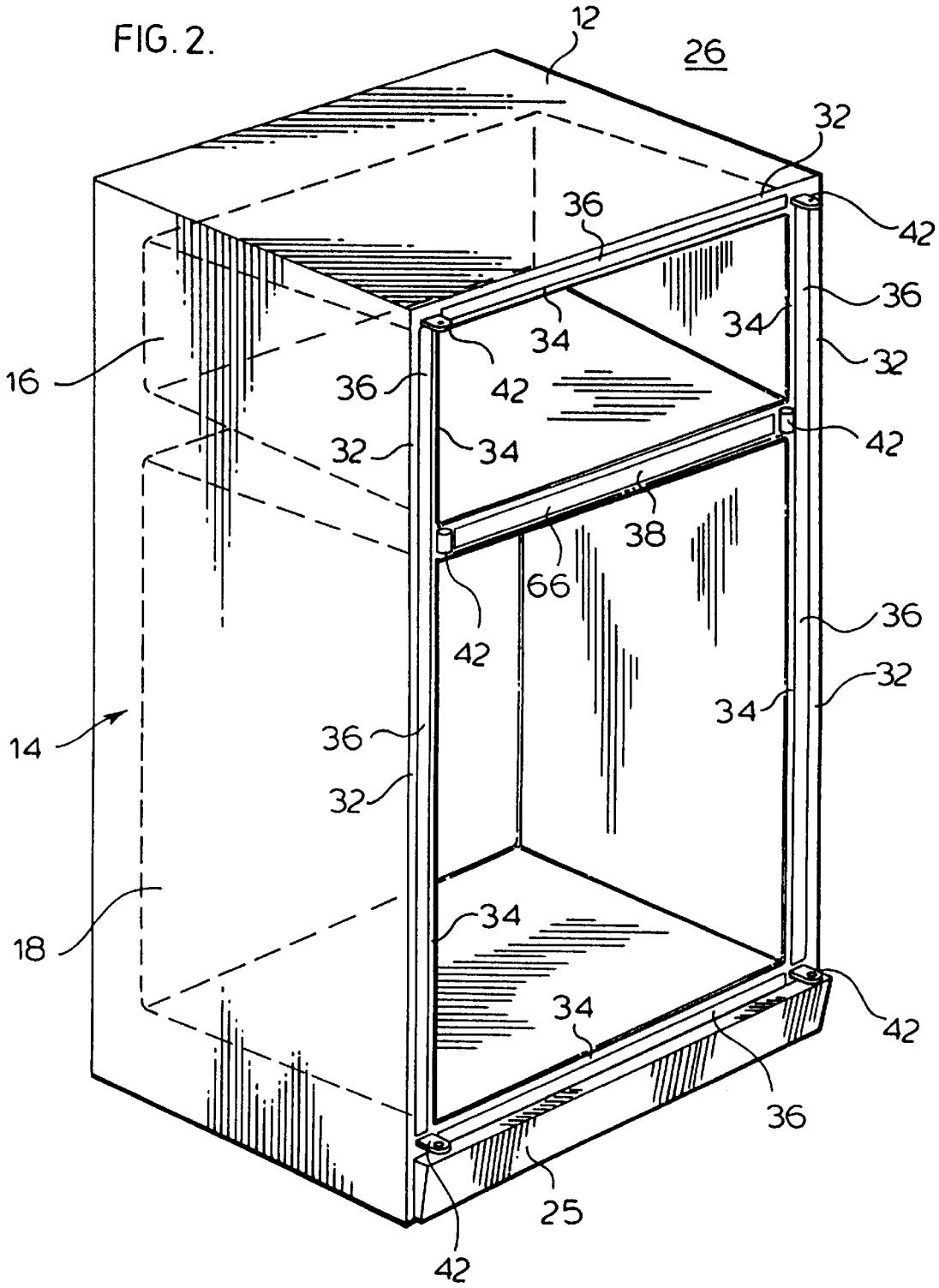
FIG. 2 is a perspective view of the refrigerator cabinet of the present invention with the doors removed.
Figure 3:
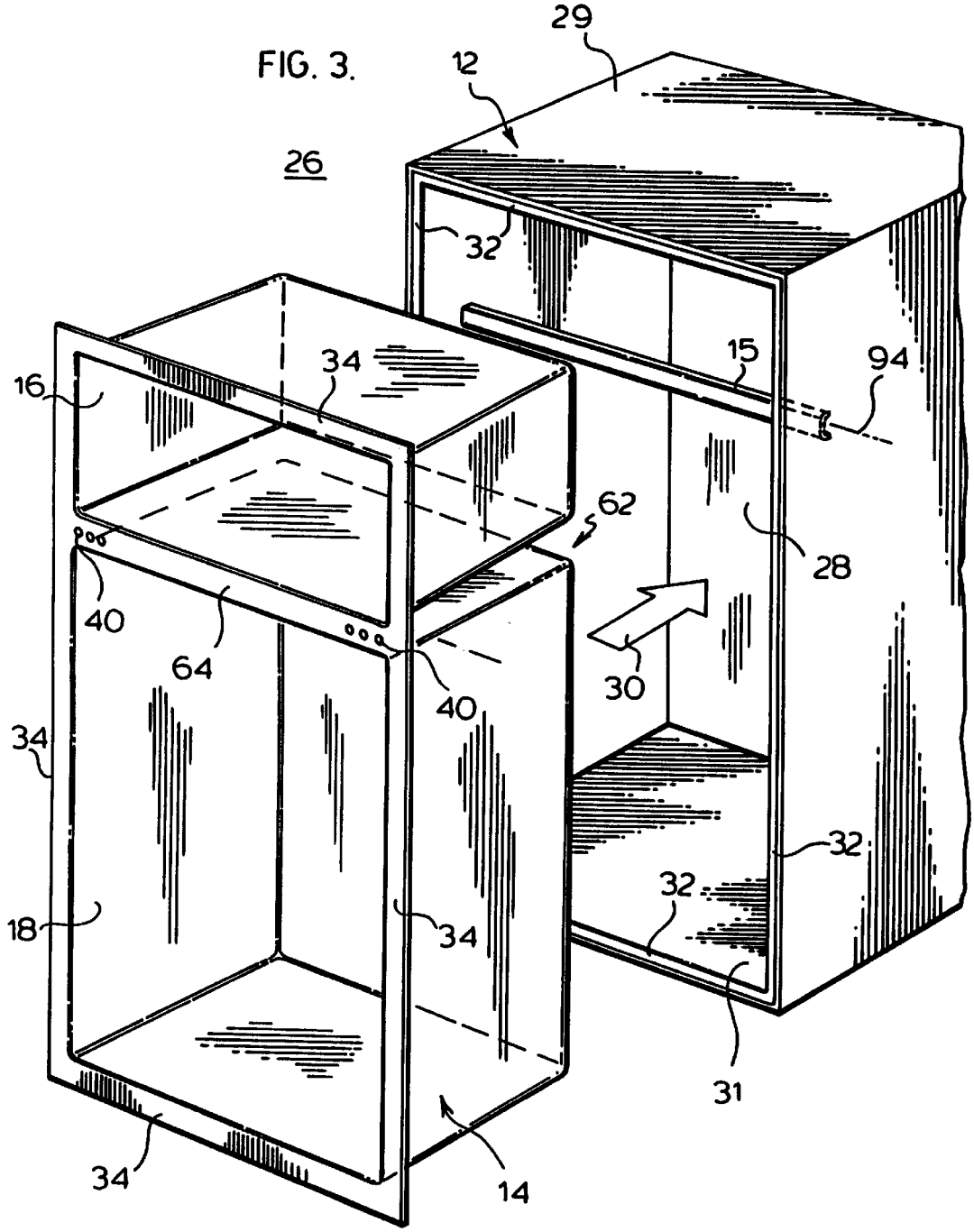
FIG. 3 is an exploded view of the refrigerator cabinet showing the interior bubble plastic liner, the mullion strap and the exterior cabinet shell.

FIG. 2 shows the cabinet 26 is without the attachment of doors 20. FIG. 3 shows an exploded illustrative view of the cabinet 26 components where the interior liner 14 is inserted into open side 28 of exterior cabinet shell 12. This is represented by arrow 30. A mullion strap 15 of metal is shown positioned in the exterior cabinet shell 12 behind the liner 14.

Referring to FIGS. 2 and 3, the exterior cabinet shell 12 has a shell edge flange 32 extending around the open side of the top wall 29, bottom wall 31 and side walls 33 towards the opening of the open side 30. The exterior cabinet shell 12 is made from sheet metal.

The interior liner 14 is adapted to fit within the exterior cabinet shell 12. The interior liner includes a liner flange 34 extending outwardly of said liner. The liner flange 34 is shown to extend outwardly of the top, bottom and side walls of the liner 14. The liner 14 is a one-piece or uni-partite plastic material made from a mold. A breaker strip 36 interconnects the interior liner 14 with the exterior cabinet shell 12. The liner further includes openings 40 through which hinges 42 (see FIG. 2) extend for the mounting of the refrigerator doors 20.

Separating the fresh food compartment 18 from the freezer compartment 16 of the uni-partite liner 14 is a mullion wall 64 as best shown in FIG. 3. Mullion wall 64 has a relatively flat surface portion extending between the side walls 33 of the exterior cabinet shell 12. The mullion cap 38 is shown in FIG. 2 whereas the mullion wall 64 is shown in FIG. 3. Mullion cap 38 has a decorative mullion cover 66 extending along the face of the mullion cap 38. The reinforcing mullion strap 15 fits in the space 62 between the freezer compartment 16 and fresh food compartment 18.

Figure 4:
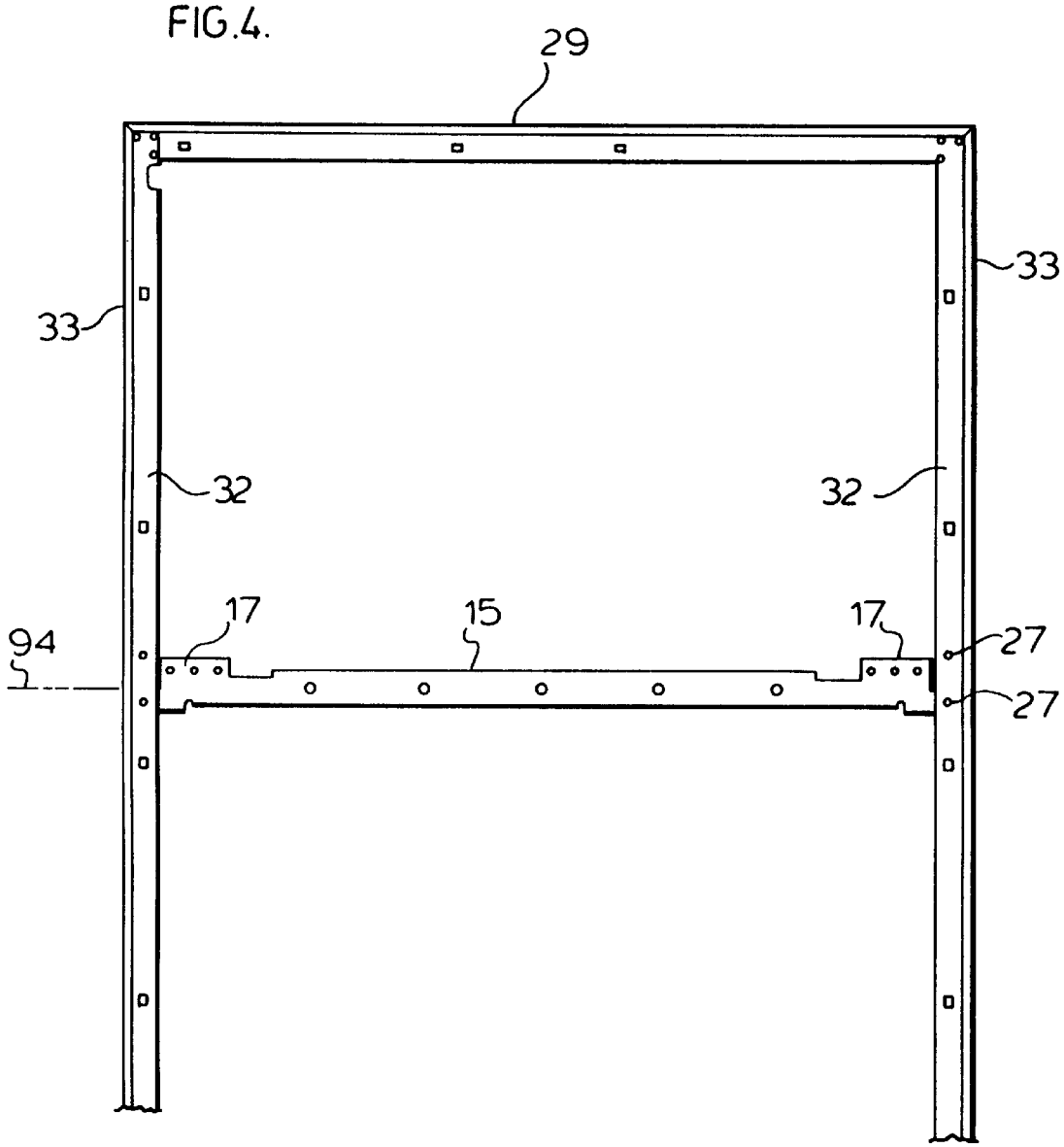
FIG. 4 is a front view of the mullion strap shown connected to the exterior cabinet shell of the refrigerator prior to the insertion of the interior liner.

The mullion strap 15 comprises a steel strap, bar or bracket 15 connected by rivets 27 (see FIG. 4). The purpose of the steel strap 15 is to provide reinforced support between side walls 33 of the refrigerator cabinet exterior shell 12. The hinges 42 pass through openings 40 in the interior liner 14 and are preferably connected to end flange brackets 17 located at the end of reinforcing mullion strap 15.

Figure 5:
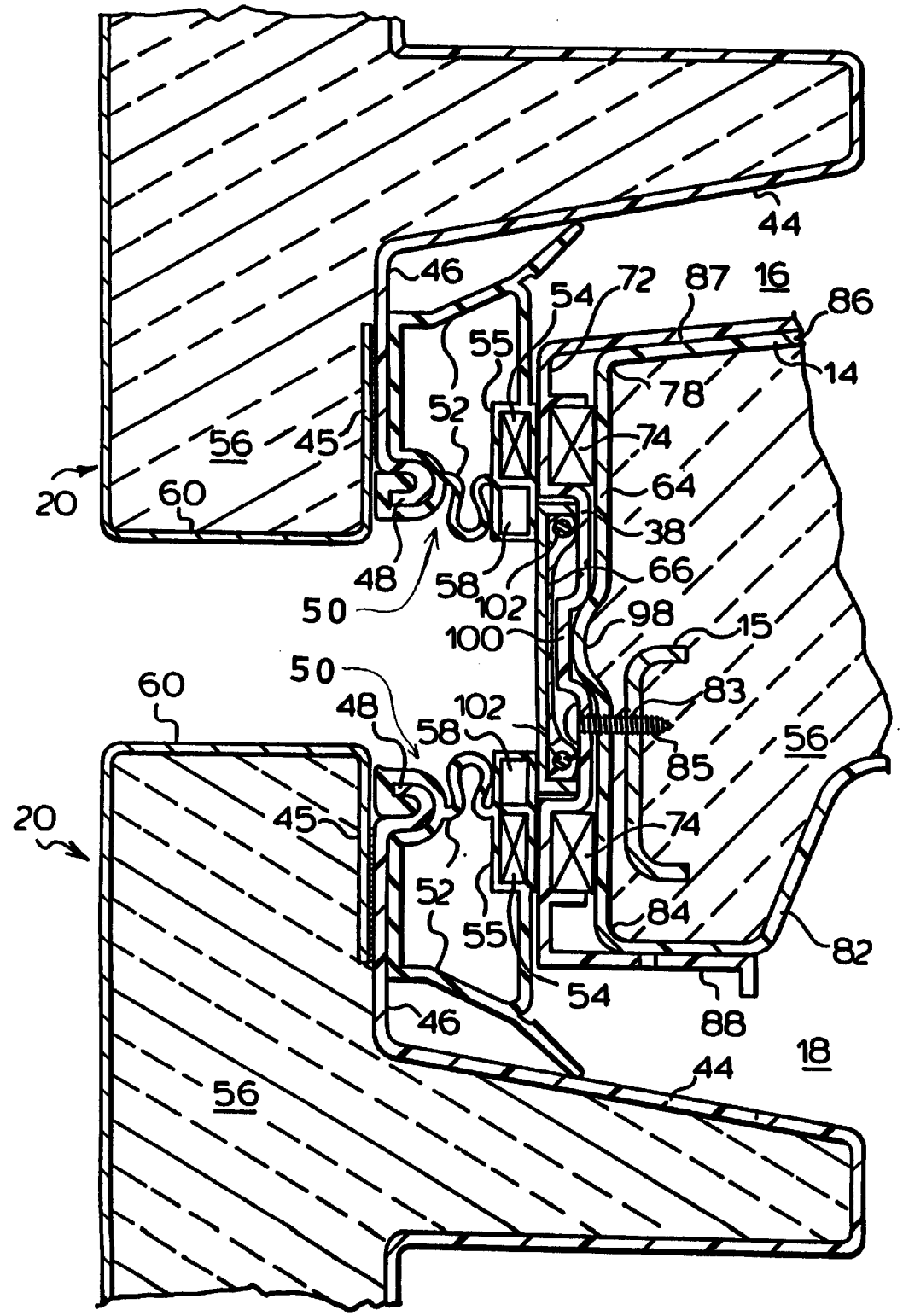
FIG. 5 a sectional view of the mullion construction of the present invention as seen along section V—V of FIG. 1.
Figure 6:
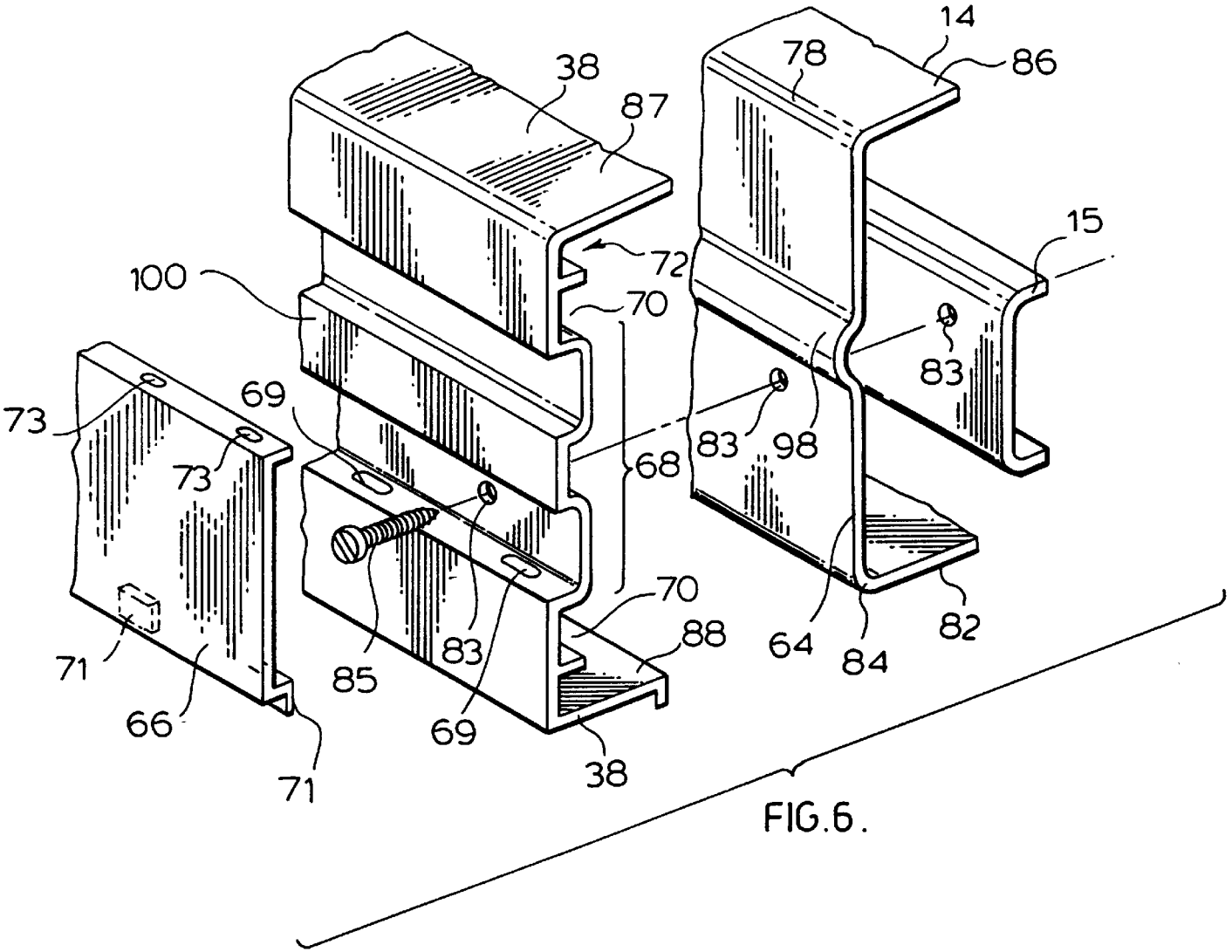
FIG. 6 is an exploded partial perspective view showing the assembly of the mullion cover and mullion cap relative to the mullion wall.

In accordance with the novel features of the present invention, reference is now made to FIGS. 5 and 6 of the drawings for a better understanding of the relationship between mullion wall 64, mullion cap 38, decorative mullion cover 66 and the reinforcing mullion strap 15.

The mullion strap 15 is positioned rearwardly of mullion wall 64 of the interior liner 14. The mullion strap 15 is spaced away from the interior liner in non-contacting relation to preclude heat transfer between the internal liner 14 and mullion strap 15. Insulation 56 is provided in the space 62 between the cavities or freezer compartment 16 and food compartment 18 of liner 14. By locating the mullion strap 15 in this position, the mullion strap 15 reinforces the side walls 33 (FIG. 4) of the refrigerator cabinet shell 12 to prevent buckling of these walls relative to each other. Further, a stronger strap or bracket 15 of metal can be used and is out of sight to the user. The strap is not in direct heat transfer relation between ambient and the liner 14.

A mullion wall 64 has an upper corner 78 which joins mullion wall 64 of the interior liner 14 to the lower floor wall 86 of freezer compartment 16. The mullion wall 64 has a lower corner 84 that joins the mullion wall 64 to the ceiling wall 82 of the fresh food compartment 18. The mullion wall 64 is a generally flat wall extending between the side walls 33 of the exterior cabinet shell 12. Mullion wall 64 has a ridge nose 98 that extends along the surface of the mullion wall 64.

A mullion cap 38 overlays the mullion wall 64. The purpose of this mullion cap 38 is to provide a hardened plastic surface against which the doors 20 of the refrigerator may close. The mullion cap 38 acts to absorb and distribute the closing forces of the doors 20 more evenly over the plastic liner mullion wall 64. The mullion cap 38 extends between the side walls 33 of the cabinet shell 12. The mullion cap 38 includes two receiving channels 70 located on an inside surface 72 of the mullion cap 38. The receiving channels 70 extend in elongate manner along the mullion cap 38. The receiving channels 70 are spaced horizontally apart with a central recess 68 located in the mullion cap 38. The receiving channels 70 are adapted to receive magnets 74 (FIG. 5) therein. Accordingly, another purpose for the mullion cap 38 is to secure sealing mullion magnets between the mullion cap 38 and mullion wall 64.

A decorative mullion cover 66 is inserted into the central recess 68 of the mullion cap 38. The mullion cap 38 has apertures 69 in the central recess 68 lower wall into which are fitted tabs 71 (FIG. 6) extending from the decorative mullion cover 66 are fitted. The top wall of decorative mullion cover 66 includes barbs 73 that force fit into the central recess 68. Alternatively, the mullion cover 66 may be secured by adhesives within the central recess 68 of mullion cap 38. The decorative mullion cover 66 is considered decorative in so far as one purpose is to provide a pleasant appearance. The mullion cover 66 is made from a plastic material. The mullion cover 66 also includes tubing 102 through which warm refrigerant passes to heat the decorative mullion cover 66 and prevent sweating where the mullion cover 66 meets door closure gasket 50. The tubing 102 is coated with a mastic material which has a relatively high thermal inertia to contain the heat over the decorative mullion cover 66 for a longer period of time.

The mullion cap 38 includes an upper flange 87 and a lower flange 88 extending rearwardly to respectively engage in interference relation the lower floor wall 86 and the upper ceiling wall 82 to secure the mullion cap relative to the mullion wall 64. The mullion cap 38 includes an elongate channel 100 in the central recess 68. The central recess 68 is disposed opposite to the elongate channel 100. That is the elongate channel 100 has a concave shape whereas the central recess 68 has a convex shape relative to the front of the cabinet. The ridge nose 98 of mullion wall 64 locates the mullion cap 38 relative to wall. The union of nose 98 and channel 100 assists in locating mullion cap 38 relative to the mullion wall 64. Further, 3 or 4 aligned spaced apart apertures 83 are located in the mullion cap 38, mullion wall 64 and mullion strap 15. Screws 85 pass through apertures 83 to secure the mullion cap 38 in place relative to the mullion wall 64 and mullion strap 15.

In FIG. 5, the door 20 is shown to comprise an exterior shell 60 having an inturned flange 45. Within the door 20 is insulating foam 56. The inside of the door is provided with a door liner 44 having an outwardly turned flange 46. The outwardly turned flange 46 is provided with a hook 48 for effecting a clasping motion with a door sealing gasket generally at 50. The gasket 50 is provided with a web 52 which holds an elongate magnet 54 in an elongated magnet chamber 55 surrounding the magnet 54. Adjacent the magnet chamber 55 is a second air chamber 58. The second air chamber 58 is located closer to the outer side 60 of door 20. The second air chamber 58 is adapted to engage or partially overlap the decorative mullion cover 66 adjacent the heating tubes 102 to permit heat transfer into the second air chambers 58 from the tubes 102. Tubes 102 are connected with the heat transfer evaporator/compressor apparatus of the refrigerator such that heat transfer fluid passes through tubes 102 to prevent sweating of the refrigerator mullion at the decorative mullion cover 66.

The mullion cap 38 thus provides a protective closing surface against which doors 20 may close. The mullion cap 38 protects the mullion wall 64 and is easier to mold to control the shape as opposed to harder to work with mullion wall 64 of the uni-partite double bubble plastic interior liner 14. The mullion cap 38 covers the mullion wall 64 such that the mullion wall 64 is not exposed to ambient. Heat transfer along the liner 14 to mullion wall 64 and to ambient must pass through the mullion cap 38. The mullion cap 38 is a plastic construction which has poorer heat transfer characteristics than metal. Thus refrigerator energy losses via the mullion are reduced. The mullion cap 38 also carries a mullion cover 66 where the cap 38 is exposed to ambient which cover includes heating tubes 102 to compensate for sweating.

What is claimed is:

1. A refrigerator cabinet comprising:

(a) an exterior metallic cabinet shell having a top wall, a bottom wall and side walls providing an open side;

(b) a plastic interior liner adapted to fit within the exterior cabinet shell, said interior liner having two interior cavities defining a fresh food compartment and a freezer compartment, said interior liner having a mullion wall extending between the side walls and facing forward towards the open side, the mullion wall separating the two interior cavities to define a space between the two interior cavities;

(c) a reinforcing metallic mullion strap extending between and connected with the side walls, the mullion strap being located in the space between the first and second cavities, the mullion strap being spaced away from and behind the mullion wall in non-contacting relation with the interior liner; and, (d) insulating foam located in the space between the first and second cavities thermally insulating the mullion strap from the interior liner.

2. The refrigerator cabinet of claim 1 wherein the cabinet includes shell edge flanges extending from the side walls into the open side, and the reinforcing mullion strap is connected to the shell edge flanges.

3. The refrigerator cabinet of claim 1 further including:

a plastic mullion cap overlying the mullion wall; the mullion cap having a central recess extending along the mullion cap between the side walls; the mullion cap defining two elongate magnet receiving channels on an inside surface of the mullion cap spaced apart from each other by the central recess;

elongate magnets extending along each of the magnet receiving channels between the mullion cap and mullion wall; and, a decorative mullion cover inserted into the central recess of the mullion cap.

4. The refrigerator cabinet of claim 3 wherein the interior liner is a one-piece liner with one of the two interior cavities having a lower floor wall meeting the mullion wall at a first upper corner and the the other of the two interior cavities having an upper ceiling wall meeting the mullion wall at a second lower corner, and the mullion cap including upper and lower flanges extending rearwardly to respectively engage in interference relation the lower floor wall and the upper ceiling wall.

5. The refrigerator of claim 4 further including a plurality of spaced apart locating screws each passing through aligned apertures in the mullion cap, the mullion wall and the mullion strap to secure the mullion cap against the mullion wall.

6. The refrigerator cabinet of claim 3 wherein the mullion cap includes apertures spaced along the central recess and the mullion cover includes barbs and tabs, the tabs adapted for insertion into the apertures and the barbs providing a reinforcing fit against the central recess.

7. The refrigerator cabinet of claim 3 wherein the mullion cover includes elongate tubes for carrying warm refrigerant to heat an outer surface of the mullion cover.

8. The refrigerator cabinet of 3 wherein the mullion strap is located along a first elongate axis parallel to a second elongate axis passing through the central recess of the mullion cap, said mullion strap having the first elongate axis spaced horizontally below the second elongate axis.

9. The refrigerator cabinet of claim 8 wherein the mullion wall includes an elongate ridge nose extending along the mullion wall, and the mullion cap having an elongate channel in the central recess disposed opposite to the central recess for receiving the ridge nose.

10. A refrigerator including a refrigerator cabinet comprising:

(a) an exterior metallic cabinet shell having a top wall, a bottom wall and side walls providing an open side;

(b) an interior plastic liner adapted to fit within the exterior cabinet shell, said interior liner having two interior cavities defining a fresh food compartment and a freezer compartment, said interior liner having a mullion wall extending between the side walls and facing forward towards the open side, the mullion wall having a continuous surface portion extending between and separating the two interior cavities to define a space between the two interior cavities;

(c) a plastic mullion cap overlying the mullion wall; the mullion cap defining two elongate magnet receiving channels on an inside surface of the mullion cap spaced apart from each other, the mullion cap having a central recess extending along the mullion cap between the side walls, the two elongate magnet receiving channels being spaced apart from each other with the central recess extending therebetween;

(d) elongate magnets extending along each of the magnet receiving channels between the mullion cap and mullion wall; and (e) a decorative plastic mullion cover inserted into the central recess of the mullion cap.

11. The refrigerator of claim 10 further including refrigerator doors attached by hinges to the exterior metallic cabinet shell adapted to close the open front of the interior cavities, each of said doors including a gasket for engaging and sealing against said mullion cap in contacting and overlapping relation to the mullion cover, said door gasket carrying a door magnet for sealing engagement with one of the two magnets carried by the mullion cap.

12. The refrigerator of claim 11 wherein the mullion cover includes elongate tubes for carrying warm refrigerant to heat an outer surface of the mullion cover and each said gasket includes a first chamber for holding said door magnet and a second air chamber adjacent the first chamber, said second air chamber at least partially contacting said decorative mullion cover adjacent elongate tubes to allow for heat transfer into said second air chamber.

13. The refrigerator cabinet of claim 10 wherein the decorative plastic mullion cap includes apertures spaced along the central recess and the mullion cover includes barbs and tabs, the tabs adapted for insertion into the apertures and the barbs providing a reinforcing fit against the central recess.

14. The refrigerator of claim 10 wherein the decorative plastic mullion cover includes elongate tubes for carrying warm refrigerant to heat an outer surface of the mullion cover.

15. The refrigerator of claim 10 wherein the mullion strap is located along a first elongate axis parallel to a second elongate axis passing through the central recess of the decorative plastic mullion cap, said mullion strap having the first elongate axis spaced horizontally below the second elongate axis.

16. The refrigerator of claim 15 wherein the mullion wall includes an elongate ridge nose extending along the mullion wall, and the mullion cap having an elongate channel in the central recess disposed opposite to the central recess for receiving the ridge nose.

17. A refrigerator including a refrigerator cabinet comprising:

(a) an exterior metallic cabinet shell having a top wall, a bottom wall and side walls providing an open side;

(b) an interior plastic liner adapted to fit within the exterior cabinet shell, said interior liner having two interior cavities defining a fresh food compartment and a freezer compartment, said interior liner having a mullion wall extending between the side walls and facing forward towards the open side, the mullion wall having a continuous surface portion extending between and separating the two interior cavities to define a space between the two interior cavities;

(c) a plastic mullion cap overlying the mullion wall; the mullion cap defining two elongate magnet receiving channels on an inside surface of the mullion cap spaced apart from each other;

(d) elongate magnets extending along each of the magnet receiving channels between the mullion cap and mullion wall;

(e) a reinforcing mullion strap extending between and connected with the side walls, the mullion strap being located in the space between the first and second cavities, the mullion strap being spaced away from and behind the mullion wall in non-contacting relation with the interior liner, and, (f) insulating foam located in the space between the first and second cavities insulating the mullion strap from the interior liner.

18. The refrigerator of claim 17 wherein said cabinet includes shell edge flanges extending from the side walls into the open side, and said reinforcing mullion strap is connected to the shell edge flanges.

19. The refrigerator of claim 17 further including a plurality of spaced apart locating screws each passing through aligned apertures in the mullion cap, the mullion wall and the reinforcing mullion strap to secure the mullion cap against the mullion wall.

20. A refrigerator including a refrigerator cabinet comprising:

(a) an exterior metallic cabinet shell having a top wall, a bottom wall and side walls providing an open side;

(b) an interior plastic liner adapted to fit within the exterior cabinet shell, said interior liner having two interior cavities defining a fresh food compartment and a freezer compartment, said interior liner having a mullion wall extending between the side walls and facing forward towards the open side, the mullion wall separating the two interior cavities to define a space between the two interior cavities;

(c) a plastic mullion cap overlying the mullion wall; the mullion cap defining two elongate magnet receiving channels on an inside surface of the mullion cap spaced apart from each other;

(d) elongate magnets extending along each of the magnet receiving channels between the mullion cap and mullion wall; and, (e) one of the two interior cavities has a lower floor wall meeting the mullion wall at a first upper corner, and the other one of the two interior cavities has an upper ceiling wall meeting the mullion wall at a second lower corner, and the mullion cap including upper and lower flanges extending rearwardly to respectively engage in interference relation the lower floor wall and the upper ceiling wall.

* * * * *

UNITED STATES PATENT AND TRADEMARK OFFICE

CERTIFICATE OF CORRECTION

PATENT NO. : 6,036,294
DATED : March 14, 2000
INVENTOR(S) : Banicevic et al.

It is certified that error appears in the above-identified patent and that said Letters Patent is hereby corrected as shown below:

Column 4,
Line 64 delete "are fitted".

Signed and Sealed this

Twenty-sixth Day of June, 2001

*Attest:*

Nicholas P. Godici

*Attesting Officer*

NICHOLAS P. GODICI
*Acting Director of the United States Patent and Trademark Office*